US011105201B2

(12) United States Patent
Koda

(10) Patent No.: US 11,105,201 B2
(45) Date of Patent: Aug. 31, 2021

(54) STEAM TURBINE

(71) Applicant: MITSUBISHI HEAVY INDUSTRIES COMPRESSOR CORPORATION, Tokyo (JP)

(72) Inventor: Takuro Koda, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 55 days.

(21) Appl. No.: 16/492,413

(22) PCT Filed: Mar. 16, 2017

(86) PCT No.: PCT/JP2017/010640
§ 371 (c)(1),
(2) Date: Sep. 9, 2019

(87) PCT Pub. No.: WO2018/167907
PCT Pub. Date: Sep. 20, 2018

(65) Prior Publication Data

US 2020/0040732 A1 Feb. 6, 2020

(51) Int. Cl.

| | |
|---|---|
| ***F01D 3/04*** | (2006.01) |
| ***F01D 25/14*** | (2006.01) |
| *F01D 5/06* | (2006.01) |
| *F01D 11/04* | (2006.01) |
| *F01K 7/20* | (2006.01) |

(52) U.S. Cl.
CPC ..... *F01D 3/04* (2013.01); *F01D 25/14* (2013.01); *F01D 5/06* (2013.01); *F01D 11/04* (2013.01); *F01K 7/20* (2013.01); *F05D 2220/31* (2013.01)

(58) Field of Classification Search
CPC ..... F01D 3/04
See application file for complete search history.

(56) References Cited

U.S. PATENT DOCUMENTS

| | | | |
|---|---|---|---|
| 6,957,945 | B2 | 10/2005 | Tong et al. |
| 2004/0101395 | A1 | 5/2004 | Tong et al. |

(Continued)

FOREIGN PATENT DOCUMENTS

| | | | |
|---|---|---|---|
| GB | 1167906 | A | 10/1969 |
| JP | H05-156902 | A | 6/1993 |
| JP | H08-189302 | A | 7/1996 |

(Continued)

OTHER PUBLICATIONS

Machine translation of Akihiro JP 08-189302 (Year: 1996).*

(Continued)

*Primary Examiner* — Woody A Lee, Jr.
*Assistant Examiner* — Brian O Peters
(74) *Attorney, Agent, or Firm* — Osha Bergman Watanabe & Burton LLP

(57) ABSTRACT

A steam turbine includes: a rotor; a casing; a thrust bearing; a steam inlet; a first pipe; a first regulation valve; a second pipe; a second regulation valve; and a control device. The control device estimates an exhaust flow rate of the steam turbine based on an operating point map which derives the exhaust flow rate of the steam turbine from an operating point of the steam turbine and estimates the thrust force applied to the thrust bearing based on the exhaust flow rate.

3 Claims, 3 Drawing Sheets

(56) References Cited

U.S. PATENT DOCUMENTS

| | | | |
|---|---|---|---|
| 2012/0017592 | A1 | 1/2012 | Maruyama et al. |
| 2013/0189078 | A1 | 7/2013 | Reinhold et al. |

FOREIGN PATENT DOCUMENTS

| | | | |
|---|---|---|---|
| JP | 2013-119860 | A | 6/2013 |
| WO | 2012-002051 | A1 | 1/2012 |

OTHER PUBLICATIONS

Machine translation of Masaaki JP 05-156902 (Year: 1993).*
International Search Report and Written Opinion in corresponding International Application No. PCT/JP2017/010640, dated May 9, 2017 (16 pages).

* cited by examiner

STEAM TURBINE

TECHNICAL FIELD

The present invention relates to a steam turbine.

BACKGROUND ART

A steam turbine includes a thrust bearing to receive a thrust force applied to a rotor during an operation of the steam turbine. Since there is a limit to a load capacity of the thrust bearing, it is necessary to perform a design in consideration of a thrust balance such that the thrust force applied to the rotor does not exceed the load capacity of the thrust bearing under any operating condition.

Patent Document 1 discloses a steam turbine in which a balance piston (dummy piston) is provided in a rotor and a thrust force (balance thrust force) in a direction opposite to that of a thrust force generated by an operation of the steam turbine is generated.

In the steam turbine disclosed in Patent Document 1, in order to regulate a pressure applied to the balance piston, a pressure adjusting valve is provided in a pipe which connects a chamber of the balance piston on a side opposite to a rotor blade side and a blade chamber in a turbine casing to each other. Accordingly, it is possible to regulate the thrust force acting on the balance piston.

CITATION LIST

Patent Literature

[Patent Document 1] Japanese Unexamined Patent Application, First Publication No. H8-189302

SUMMARY OF INVENTION

Technical Problem

In the steam turbine disclosed in Patent Document 1, there is a problem that a regulation width of the balance thrust force is small. That is, a maximum balance thrust force is dependent to an internal pressure of the blade chamber to which the pipe is connected, and thus, there is a problem that it is not possible to cope with a case where it is necessary to generate a larger balance thrust force.

An object of the present invention is to provide a steam turbine capable of coping with a thrust force applied to a thrust bearing using a balance piston even in a case where the thrust force is largely changed.

Solution to Problem

According to a first aspect of the present invention, there is provided a steam turbine including: a rotor which has a rotor body extending along an axis, a plurality of stages of rotor blade rows, and a balance piston provided on one axial side of the plurality stages of rotor blade rows; a casing which covers the rotor from an outside in a radial direction relative to the axis and forms, between the casing and the rotor, a plurality of blade chambers corresponding to the rotor blade rows, a first chamber on the other axial side of the balance piston, and a second chamber on the one axial side of the balance piston; a thrust bearing which receives a thrust force applied to the rotor; a steam inlet through which steam is introduced into the first chamber; a first pipe which connects a second chamber and one blade chamber of the plurality of blade chambers to each other; a first regulation valve which is provided in the first pipe; a second pipe which connects the second chamber and another blade chamber of the plurality of blade chambers to each other, another blade chamber having an internal pressure different from that of the one blade chamber; a second regulation valve which is provided in the second pipe; and a control device which controls the first regulation valve and the second regulation valve based on a thrust force applied to the thrust bearing.

According to this configuration, it is possible to regulate a thrust force applied to the balance piston with a larger regulation width. Accordingly, even in a case where a thrust force applied to the thrust bearing is largely changed, it is possible to cope with the large change of the thrust force using the balance piston.

In the steam turbine, the control device may estimate an exhaust flow rate of the steam turbine based on an operating point map which derives the exhaust flow rate of the steam turbine from an operating point of the steam turbine, and may estimate the thrust force applied to the thrust bearing, based on the exhaust flow rate.

According to this configuration, in the estimation of the thrust force, a measurement device such as a device for measuring the temperature of the thrust bearing is not required, and thus, it is possible to operate the steam turbine at a low cost.

The steam turbine may further include a metal temperature measuring device which measures a metal temperature of the thrust bearing, and the control device may estimate the thrust force applied to the thrust bearing, based on the metal temperature of the thrust bearing.

For example, according to this configuration, it can be estimated that the thrust force is excessive in a case where the metal temperature of the thrust bearing is higher than a threshold value.

The steam turbine may include a load measuring device which measures a load applied to the thrust bearing and the control device may estimate the thrust force applied to the thrust bearing, based on the load applied to the thrust bearing.

According to this configuration, it is possible to directly estimate the thrust force by referring to the load applied to the thrust bearing.

Advantageous Effects of Invention

According to the present invention, it is possible to regulate a thrust force applied to the balance piston with a larger regulation width. Accordingly, even in a case where a thrust force applied to the thrust bearing is largely changed, it is possible to cope with the large change of the thrust force using the balance piston.

DESCRIPTION OF EMBODIMENTS

Figure 1:
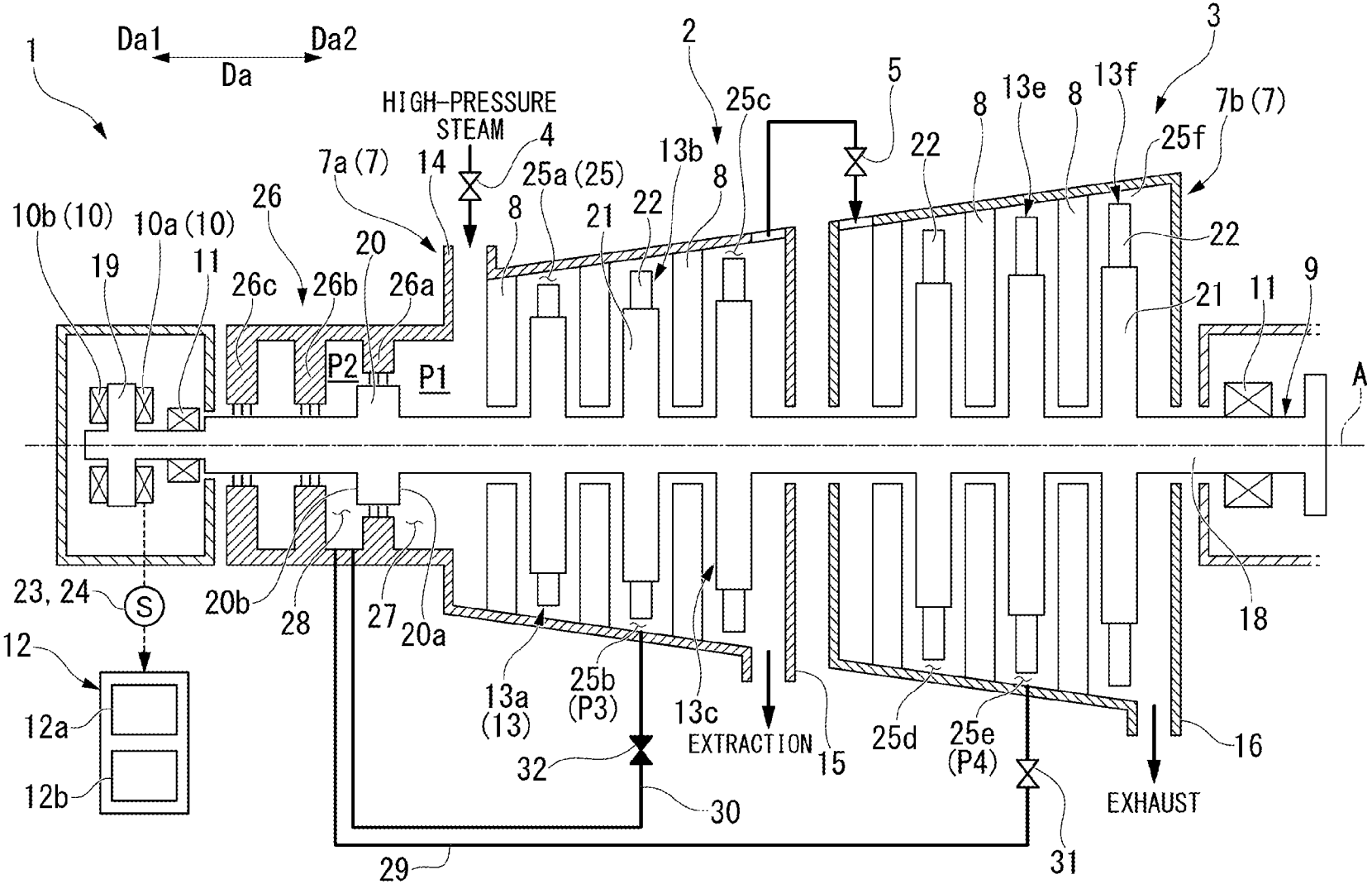
FIG. 1 is a schematic view showing the entire configuration of a steam turbine of an embodiment of the preset invention.

As shown in FIG. 1, a steam turbine 1 of the present embodiment is an external combustion engine which takes out energy of steam as a rotational power and is used for a generator or the like in a power plant.

The steam turbine 1 of the present embodiment is a steam turbine which has a high-pressure turbine 2 and a low-pressure turbine 3 and which can extract the steam from an intermediate state. The steam turbine 1 has a steam regulating valve 4 and an extraction regulation valve 5. The steam regulating valve 4 increases or decreases a flow rate of high-pressure steam supplied to the high-pressure turbine 2. The extraction regulation valve 5 increases or decreases a flow rate of steam supplied from the high-pressure turbine 2 to the low-pressure turbine 3. In addition, the steam turbine 1 has a speed governor (electric governor, not shown) which controls the steam regulating valve 4 and the extraction regulating valve 5 according to a rotation speed of a rotor 9 or the like.

The steam turbine includes a casing 7, a plurality of stationary blade rows 8 which are fixed to the casing 7, a rotor 9 which extends along an axial direction Da, a thrust bearing 10 which receives a thrust force applied to the rotor 9, journal bearings 11 which rotatably support the rotor 9, and a control device 12. The rotor 9 has rotor blade rows 13 which are disposed between the stationary blade rows 8 adjacent to each other in the axial direction Da.

The stationary blade rows 8 are formed at intervals in the axial direction Da. Each stationary blade row 8 includes a plurality of stationary blades provided at intervals in a circumferential direction.

Moreover, hereinafter, a direction in which an axis A of the rotor 9 extends will be referred to as an axial direction Da, a circumferential direction with respect to the axis A will be simply referred to as a circumferential direction, and a radial direction with respect to the axis A will be simply referred to as a radial direction. In addition, a left side in FIG. 1 will be referred to as one axial side Da1 and a right side in FIG. 1 will be referred to as the other axial side Da2.

The high-pressure steam is introduced from the one axial side Da1 (upstream side), flows to the other axial side Da2 (downstream side), and is discharged.

A flow path of the steam is formed inside the casing 7. The casing 7 covers the rotor 9 from an outside in the radial direction. The casing 7 has a high-pressure casing 7*a* which forms an outline of the high-pressure turbine 2 and a low-pressure casing 7*b* which forms an outline of the low-pressure turbine 3.

A steam inlet 14 is formed in the high-pressure casing 7*a*, and the high-pressure steam is introduced from upstream sides of the stationary blade rows 8 and the rotor blade rows 13 into the high-pressure casing 7*a* through the steam inlet 14. An extraction outlet 15 is formed in a downstream portion of the high-pressure casing 7*a*, and the steam which has passed through the high-pressure casing 7*a* is extracted through the extraction outlet 15.

An exhaust outlet 16 is formed in a downstream portion of the low-pressure casing 7*b*, and the steam which has passed through the low-pressure casing 7*b* is exhausted through the exhaust outlet 16.

The rotor blade rows 13 and the stationary blade rows 8 are alternately disposed in the axial direction Da. Each of the high-pressure turbine 2 and the low-pressure turbine 3 has three stages of rotor blade rows 13 and three stages of stationary blade rows 8.

The rotor 9 has a rotor body 18 which extends along the axial direction Da, a thrust collar 19, a balance piston 20, a plurality of disks 21, and a plurality of blade bodies 22. The plurality of disks 21 are provided at intervals along the axial direction Da.

Each disk 21 is formed to extend radially outward from the rotor body 18. The plurality of blade bodies 22 are provided on an outer peripheral surface of the disk 21 at intervals in the circumferential direction.

Each rotor blade row 13 includes the disk 21 and the plurality of blade bodies 22. That is, the plurality of rotor blade rows 13 and the balance piston 20 are provided on the same rotor body 18.

The rotor body 18 extends along the axis A to penetrate the casing 7. An intermediate portion of the rotor body 18 in the axial direction Da is accommodated in the casing 7, and both end portions of the rotor body 18 in the axial direction Da protrude to the outside of the casing 7. Both end portions of the rotor 9 is rotatably supported around the axis A by the journal bearings 11. The thrust bearing 10 which receives the thrust force applied to the rotor 9 is provided on the one axial side Da1 of the journal bearing 11 on the one axial side Da1.

The thrust collar 19 is provided on an end portion on the one axial side Da1 of the rotor 9. The thrust collar 19 protrudes radially outward from an outer peripheral surface of the rotor body 18. The thrust bearing 10 is provided to correspond to the thrust collar 19 which is formed on the rotor 9.

The thrust bearing 10 has a first thrust bearing 10*a* which supports the thrust collar 19 from the other axial side Da2 and a second thrust bearing 10*b* which supports the thrust collar 19 from the one axial side Da1. The high-pressure steam flows from the upstream side to the downstream side, and thus, a thrust force acting on the rotor blade row 13 is supported by the first thrust bearing 10*a*.

In addition, the thrust bearing 10 has a sensor which includes a temperature measuring device 23 which measures a metal temperature of the first thrust bearing 10*a* and a load measuring device which measures a load applied to the first thrust bearing 10*a*.

A plurality of blade chambers 25 are formed between the casing 7 and the rotor 9 inside the casing 7. The steam turbines 1 has six blade chambers 25 from a first blade chamber 25*a* corresponding to the rotor blade row 13 which is disposed on the most upstream side (one axial side Da1) to a sixth blade chamber 25*f* corresponding to the rotor blade row 13*f* which is disposed on the most downstream side. While the steam turbine 1 is operated, an internal pressure in the first blade chamber 25*a* is highest, and an internal pressure in the sixth blade chamber 25*f* is lowest. That is, an internal pressure in the blade chamber decreases toward the downstream side.

The steam turbine 1 has a gland 26 which prevents the steam introduced from the steam inlet 14 from leaking from a rotor penetration portion of the casing 7. For example, the grand 26 is constituted by a labyrinth ring.

In the steam turbine 1, an HP gland 26*a*, an MP gland 26*b*, and an LP gland 26*c* are provided in this order from the other axial side Da2 toward the one axial side Da1.

The balance piston 20 is provided inside the high-pressure casing 7*a* and is provided on the one axial side Da1 of the plurality of rotor blade rows 13*a*. The balance piston protrudes radially outward from the outer peripheral surface of the rotor body 18. That is, an outer diameter of the balance piston 20 is larger than an outer shape of the rotor body 18.

In the casing 7, a first chamber 27 which is formed on the other axial side Da2 (rotor blade row 13 side) of the balance piston 20 and a second chamber 28 which is formed on the one axial side Da1 of the balance piston 20 are provided between the casing 7 and the rotor 9.

The balance piston 20 has a first surface 20*a* facing the other axial side Da2 (first chamber 27) and a second surface 20*b* facing the one axial side Da1 (second chamber 28). An internal pressure of the first chamber 27 acts on the first surface 20*a*. An internal pressure of the second chamber 28 acts on the second surface 20*b*.

An outer peripheral surface of the balance piston 20 is sealed by the HP gland 26.

The first chamber 27 and a fifth blade chamber 25*e* corresponding to a fifth rotor blade row 13*e* are connected to each other by a first pipe 29. A first regulation valve 31 is provided in the first pipe 29.

The second chamber 28 and a second blade chamber 25*b* corresponding to the second rotor blade row 13*b* are connected to each other by a second pipe 30. A second regulation valve 32 is provided in the second pipe 30.

That is, the second chamber 28 and the fifth blade chamber 25*e* which is one blade chamber of the plurality of blade chambers 25 are connected to each other by the first pipe 29, and the second chamber 28 and the second blade chamber 25*b* which is another chamber having an internal pressure different from that of the fifth blade chamber 25*e* are connected to each other by the second pipe 30.

The second pipe 30 may branch off from the first pipe 29.

In a case where the first regulation valve 31 is open and the second regulation valve 32 is closed, an internal pressure P2 of the second chamber 28 is approximately the same as an internal pressure P4 of the fifth blade chamber 25*e*. Moreover, in a case where the first regulation valve 31 is closed and the second regulation valve 32 is open, the internal pressure P2 of the second chamber 28 is approximately the same as an internal pressure P3 of the second blade chamber 25*b*.

The control device 12 has a bearing temperature determination unit 12*a* which performs a determination based on the metal temperature of the thrust bearing 10 and an exhaust flow rate determination unit 12*b* which performs a determination based on an exhaust flow rate of the steam turbine 1.

Next, an operation map of the steam turbine 1 will be described. In the present embodiment, the exhaust flow rate determination unit 12*b* of the control device 12 of the steam turbine 1 can derive the exhaust flow rate of the steam turbine 1 with reference to the operating point map.

Figure 2:
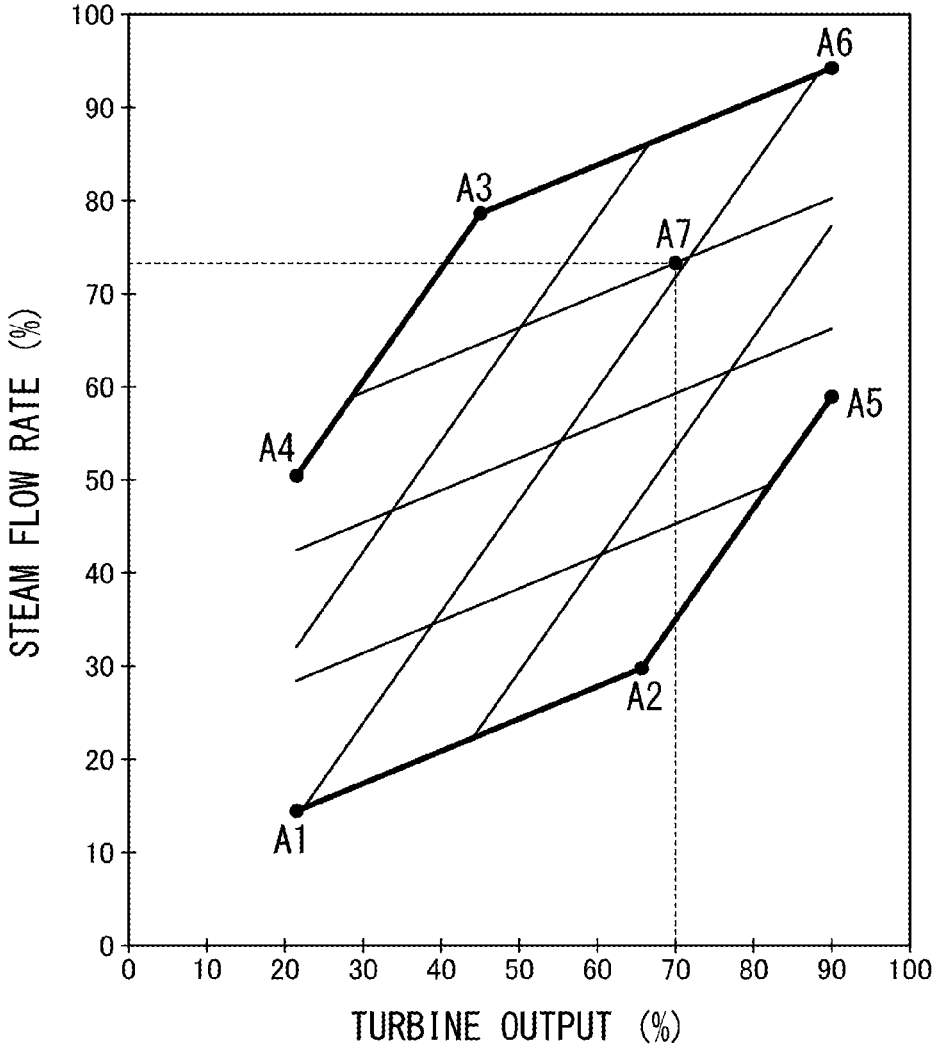
FIG. 2 is an operating point map referred to by a control device of the steam turbine of the embodiment of the present invention.

As shown in FIG. 2, in the operating point map, a horizontal axis indicates a turbine output (output of the steam turbine 1) and a vertical axis indicates an inlet steam flow rate (a flow rate of the steam flowing in from the steam inlet 14). According to a relative relationship therebetween, a scale is graduated in a vertical axis direction from 0% (line segment A1-A2 in FIG. 2) to 100% (line segment A3-A4 in FIG. 2) for an extraction flow rate, and a minimum exhaust operating point (line segment A4-A3 in FIG. 2) and a maximum exhaust operating point (line segment A2-A5 in FIG. 2) are shown for an exhaust flow rate.

For example, the turbine output is 70% and the extraction flow rate is 75%, an operating point A7 is determined on the operating point map, and the inlet steam flow rate and the exhaust flow rate can be derived at the operating point A7.

Here, the turbine output corresponds to a rotation speed control output signal of the rotor 9, the inlet steam flow rate corresponds to an operation signal of the steam regulating valve 4, and the extraction flow rate corresponds to an operation signal of the extraction regulating valve 5. Accordingly, for example, the rotation speed control output signal of the rotor 9 may be referred instead of the turbine output. In addition, the inlet steam flow rate may be obtained from a flow rate of steam flowing through the extraction outlet 15 and a flow rate of steam flowing through the exhaust outlet 16.

In this manner, a method of deriving the exhaust flow rate of the steam turbine 1 with reference to the operating point map is not limited to the turbine output and the extraction flow rate, and can use various parameters.

Next, a control method of the steam turbine 1 of the present embodiment will be described.

Figure 3:
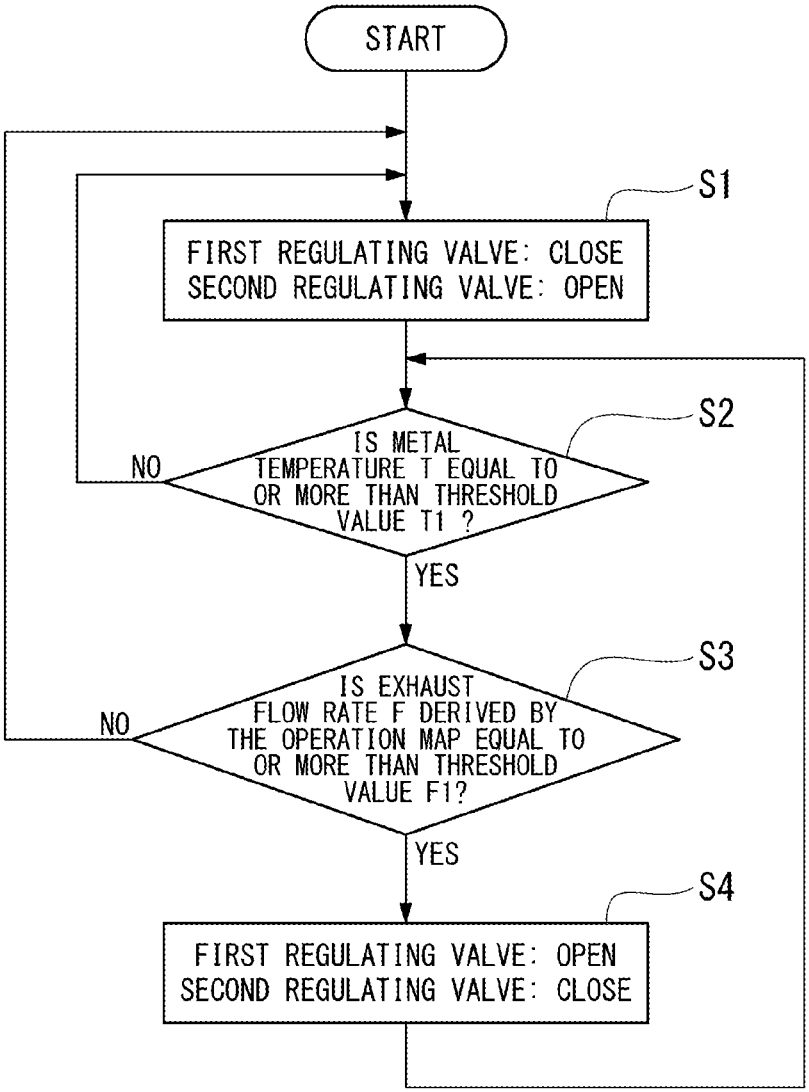
FIG. 3 is a flowchart explaining a control method of the steam turbine of the embodiment of the present invention.

As shown in FIG. 3, the control method of the steam turbine 1 includes a normal operation mode setting step S1 of setting the first regulation valve 31 and the second regulation valve 32 to normal operation modes, a bearing temperature determination step S2 of estimating the thrust force based on a metal temperature T of the first thrust bearing 10*a*, an exhaust flow rate determination step S3 of deriving the exhaust flow rate based on the operating point map in a case where the metal temperature T is equal to or more than a threshold value T1 and estimating the thrust force based on the exhaust flow rate, and an emergency mode setting step S4 of setting the regulating valves 31 and 32 to emergency modes in a case where the exhaust flow rate derived with reference to the operating point map is equal to or more than a threshold value F1.

If the high-pressure steam is introduced via the steam inlet 14 from a boiler (not shown) or the like, the steam flows into the blade chamber 25 of the high-pressure chamber 2 and the blade chamber 25 of the low-pressure turbine 3, and the temperature and the pressure of the steam decrease while the steam applies a rotation force to the rotor 9. After the steam finishes the work, the steam is discharged to the outside of the steam turbine 1 via the exhaust outlet 16.

During the operation of the steam turbine 1, the thrust force toward the other axial side Da2 is generated in the rotor 9. For example, the thrust force toward the other axial side Da2 is generated by a differential pressure generated between the blade body 22 and the disk 21. The thrust force is supported by the first thrust bearing 10*a*.

On the other hand, a thrust force (balance thrust force) toward the one axial side Da1 is generated in the balance pinion 20 by a differentia pressure between the first chamber 27 and the second chamber 28. The steam turbine 1 of the present embodiment is configured such that the thrust force and the balance thrust force balance with each other by communicating the second blade chamber 25*b* with the second chamber 28 each other and by making the internal pressure of the second blade chamber 25*b* and the internal pressure of the second chamber 28 approximately the same.

In the normal operation mode setting step S1, the control device 12 sets the steam turbine 1 to the normal operation mode after the steam turbine 1 starts. In the normal operation mode, the second regulation valve 32 is set to the open state, and the first regulation valve 31 is set to the closed state.

Here, an internal pressure in the first chamber 27 will be referred to as P1, an internal pressure in the second chamber 28 will be referred to as P2, a pressure in the second blade chamber 25*b* will be referred to as P3, and a pressure in the fifth blade chamber 25*e* will be referred to as P4.

At the time of the normal operation of the steam turbine 1, the second regulation valve 32 is open and the first regulation valve 31 is closed. Accordingly, the internal pressure P2 of the second chamber 28 and the internal pressure P3 of the second blade chamber 25*b* are approximately the same as each other.

Therefore, the thrust force and the balance thrust force balance with each other, and forces acting on the entire rotor 9 in the axial direction Da balance with each other. That is, the thrust force applied to the first thrust bearing 10*a* is within a load capacity range of the first thrust bearing 10*a*.

The bearing temperature determination step S2 is a step of monitoring the metal temperature of the first thrust bearing 10*a* during the operation of the steam turbine 1. The bearing temperature determination unit 12*a* of the control device 12 determined whether or not the metal temperature of the first thrust bearing 10*a* is equal to or more than the threshold value T1. For example, the threshold value T1 can be set to 100° C.

The bearing temperature determination unit 12*a* of the control device 12 continues the normal operation mode in a case (NO) where the metal temperature T of the first thrust bearing 10*a* is lower than the threshold value T1.

On the other hand, in a case (YES) where the metal temperature T of the first thrust bearing 10*a* is equal to or more than the threshold value T1, the exhaust flow rate determination step S3 is performed. The exhaust flow rate determination step S3 is a step of deriving the exhaust flow rate of the steam turbine 1 based on the operating point map and estimating the thrust force based on the exhaust flow rate.

The exhaust flow rate determination unit 12*b* of the control device 12 drives the exhaust flow rate of the steam turbine 1 with reference to the operating point map. Next, the exhaust flow rate determination unit 12*b* of the control device 12 determines whether or not an exhaust flow rate F of the steam turbine 1 is equal to or more than the threshold value F1. If the maximum exhaust operating point is set to the exhaust flow rate 100% and the minimum exhaust operating point is set to the exhaust flow rate 0%, the threshold value F1 can be set to the exhaust flow rate 90%.

In a case where the exhaust flow rate F is smaller than the threshold value F1, the exhaust flow rate determination unit 12*b* of the control device 12 continues the normal operation mode. This is because it is considered that an increase in the metal temperature T of the first thrust bearing 10*a* is a phenomenon due to wear of the thrust bearing 10 or a phenomenon due to deterioration of oil properties. That is, in a case where it is considered that the increase in the metal temperature T is not improved even if the differential pressure before and after the balance piston 20 is regulated, the normal operation mode continues.

On the other hand, in a case where the exhaust flow rate F is equal to or more than the threshold value F1, it is considered that the thrust force is excessive according to the increase in the exhaust flow rate F. Accordingly, the exhaust flow rate determination unit 12*b* of the control device 12 sets the mode to an emergency mode in order to decrease the load of he first thrust bearing 10*a*. In the emergency mode, the second regulation valve 32 is set to the closed state and the first regulation valve 31 is set to the open state.

Therefore, the internal pressure P2 of the second chamber 28 is approximately the same as the internal pressure P4 of the fifth blade chamber 25*e*. The internal pressure P4 of the fifth blade chamber 25*e* is lower than the internal pressure P3 of the second blade chamber 25*b*, and thus, the internal pressure P2 of the second chamber 28 decreases, and the balance thrust force increases toward the one axial side Da1. Accordingly, the load of the first thrust bearing 10*a* decreases.

According to the above-described embodiment, switching is performed between the first pipe 29 and the second pipe 30 according to the thrust force applied to the rotor 9, and thus, the thrust force applied to the balance piston 20 can be regulated with a larger regulation width. Accordingly, even in a case where the thrust force applied to the thrust bearing 10 is largely changed, it is possible to cope with the large change of the thrust force using the balance piston 20.

In addition, the thrust force is estimated using the operation point map in addition to the metal temperature T of the thrust bearing 10, and thus, it is possible to more accurately estimate the state of the thrust bearing 10.

In addition, in the above-described embodiment, the bearing temperature determination unit 12*a* estimates the thrust force based on the metal temperature T. However, the present invention is not limited to this. The thrust force may be estimated based on a load measured by a load measuring device 24 having a sensor. Accordingly, it is possible to more directly estimate the thrust force.

Hereinbefore, the embodiment of the present invention is described in detail with reference to the drawings. However, specific configurations are not limited to this embodiment, and design changes or the like within a scope which does not depart from the gist of the present invention are included.

For example, in the above-described embodiment, two pipes which communicate with the second chamber 28 and the blade chamber 25 are provided. However, the present invention is not limited to this, and for example, three or more pipes may communicate with the second chamber 28 such that a set range of the internal pressure P2 of the second chamber 28 is widened.

Moreover, in the above-described embodiment, the regulating valves 31 and 32 are opened or closed based on the exhaust flow rate F of the steam turbine 1 estimated by the metal temperature T of the thrust bearing 10 and the operating point map. For example, the regulating valves 31 and 32 may be controlled based on only the operating point map. That is, in a case where it is estimated that the exhaust flow rate F is 90% of the maximum exhaust operating point by the operation point map, the regulating valves 31 and 32 are switched. In addition, the regulating valves 31 and 32 are controlled based on only the metal temperature T of the thrust bearing 10, or the regulating valves 31 and 32 are controlled based on only the load applied to the thrust bearing 10.

In addition, in the above-described embodiment, the regulating valves 31 and 32 are completely opened or closed. However, the present invention is not limited to this, and opening degrees of the regulating valves 31 and 32 may be regulated so as to regulate the internal pressure P2 of the second chamber 28.

REFERENCE SIGNS LIST

1: steam turbine
2: high-pressure turbine
3: low-pressure turbine
4: steam regulating valve
5: extraction regulating valve
7: casing
7*a*: high-pressure casing
7*b*: low-pressure casing
8: stationary blade row
9: rotor
10: thrust bearing
11: journal bearing
12: control device
12*a*: bearing temperature determination unit
12*b*: exhaust flow rate determination unit
13 (13*a*, 13*b*, 13*c*, 13*d*, 13*e*, 13*f*): rotor blade row
14: steam inlet
15: extraction outlet
16: exhaust outlet
18: rotor body
19: thrust collar

20: balance piston
20*a*: first surface
20*b*: second surface
21: disk
22: blade body
23: temperature measuring device
25 (25*a*, 25*b*, 25*c*, 25*d*, 25*e*, 25*f*): blade chamber
26: gland
27: first chamber
28: second chamber
29: first pipe
30: second pipe
31: first regulation valve
32: second regulation valve
A: axis
Da: axial direction
Da1: one axial side
Da2: the other axial side

The invention claimed is:

1. A steam turbine comprising:

a rotor which has a rotor body extending along an axis, a plurality of stages of rotor blade rows, and a balance piston provided on one axial side of the plurality stages of rotor blade rows;

a casing which covers the rotor from an outside in a radial direction relative to the axis and forms, between the casing and the rotor, a plurality of blade chambers corresponding to the rotor blade rows, a first chamber on a first axial side of the balance piston that is closer to the plurality stages of rotor blade rows, and a second chamber on a second axial side of the balance piston that is farther to the plurality stages of rotor blade rows;

a thrust bearing which receives a thrust force applied to the rotor;

a steam inlet through which steam is introduced into the first chamber;

a first pipe which connects the second chamber and one blade chamber of the plurality of blade chambers to each other;

a first regulation valve which is provided in the first pipe;

a second pipe which connects the second chamber and another blade chamber of the plurality of blade chambers to each other, another blade chamber having an internal pressure different from that of the one blade chamber;

a second regulation valve which is provided in the second pipe; and a controller which controls:

the first regulation valve based on the thrust force applied to the thrust bearing such that an internal pressure of the second chamber is approximately same as an internal pressure of the one blade chamber; and the second regulation valve based on the thrust force applied to the thrust bearing such that the internal pressure of the second chamber is approximately same as an internal pressure of the another blade chamber, wherein the controller estimates an exhaust flow rate of the steam turbine based on an operating point map which derives the exhaust flow rate of the steam turbine from an operating point of the steam turbine, and estimates the thrust force applied to the thrust bearing, based on the exhaust flow rate.

2. The steam turbine according to claim 1, further comprising:

a sensor which measures a metal temperature of the thrust bearing, wherein the controller estimates the thrust force applied to the thrust bearing, based on the metal temperature of the thrust bearing.

3. The steam turbine according to claim 1, further comprising:

a sensor which measures a load applied to the thrust bearing, wherein the controller estimates the thrust force applied to the thrust bearing, based on the load applied to the thrust bearing.

* * * * *